United States Patent [19]

Abe et al.

[11] 4,308,818

[45] Jan. 5, 1982

[54] APPARATUS FOR COATING BOTTLES OR LIKE CYLINDRICAL ARTICLES

[75] Inventors: Ichiro Abe; Takashi Suzuki; Toshio Ebara, all of Takasaki, Japan

[73] Assignee: Kirin Beer Kabushiki Kaisha, Tokyo, Japan

[21] Appl. No.: 136,865

[22] Filed: Apr. 3, 1980

[30] Foreign Application Priority Data

Apr. 9, 1979 [JP] Japan ..... 54-42670

[51] Int. Cl.[3] ..... B05C 1/02

[52] U.S. Cl. ..... 118/211; 118/219; 118/220; 118/230; 118/232

[58] Field of Search ..... 118/230, 232, 233, 218, 118/219, 211, 220; 101/39, 40

[56] References Cited

U.S. PATENT DOCUMENTS 2,111,039 3/1938 Albertoli ..... 101/39
2,944,510 7/1960 Jeremiah ..... 118/233
3,452,709 7/1969 Hartmeister et al. ..... 118/319 X
3,710,753 1/1973 Birchall et al. ..... 118/230 X

*Primary Examiner*—John P. McIntosh
*Attorney, Agent, or Firm*—Ladas & Parry

[57] ABSTRACT

Apparatus for coating with a desired substance a succession of beverage bottles traveling along an arcuate guideway. A star wheel assembly, rotatable about an axis at which the arcuate guideway is centered, feeds the successive bottles along the guideway, further coacting with the opposed guideway-defining surface to cause rotation of each bottle about its own axis. Coaxially mounted on the star wheel assembly, either for simultaneous rotation therewith or for independent rotation, one or more annular rows of discrete coating bodies or one or more coating rolls apply the coating substance to the successive bottles, creating one or more band-shaped coatings around each bottle. In one embodiment the star wheel assembly is replaced by a feed roll assembly comprising a pair of annular rows of independently rotatable feed rolls.

13 Claims, 15 Drawing Figures

APPARATUS FOR COATING BOTTLES OR LIKE CYLINDRICAL ARTICLES

BACKGROUND OF THE INVENTION

This invention relates to apparatus for coating articles of essentially cylindrical or round shape, such as beverage bottles and cans, with any desired substance. The invention is directed more specifically to such apparatus suitable for creating one or more band-shaped coatings of paints, pastes, or other substances around the body of each of beverage bottles being fed in succession along a predetermined path.

Beverage bottles have heretofore been coated with paints, pastes or the like by dropping the coating substance on the bottles, by dipping the bottles in the coating substance, or by spraying. An objection to such conventional practices is their incompatibility with other bottling-line operations, because they require the bottles to be at a temporary standstill while being coated. The advent of apparatus has long been awaited which is capable of painting or otherwise coating a succession of beverage bottles being fed along a bottling line, without arresting their travel.

The coating of beverage bottles is also required for protection of their surfaces. Of the various parts of a typical beverage bottle, the body, shoulder, and bottom end portions are most liable to develop scratches and other surface imperfections. Protective coatings may therefore be applied only to such vulnerable surface portions of the bottle, rather than to its entire surfaces. Another application of this invention is the coating of bottles with a paste for labeling. In this application, too, the coating of only a part or parts of each bottle body usually suffices.

SUMMARY OF THE INVENTION

The present invention provides improved apparatus capable of efficiently and continuously coating with any desired substance a succession of substantially cylindrical or round articles while they are being fed along an arcuate path. The coating apparatus comprises feed means, rotatable about a predetermined axis at which the arcuate path is centered, for feeding the successive articles along the path. The feed means is further effective, in coaction with guide means defining the arcuate path, to cause rotation of each article about its own axis. The apparatus also includes coating means rotatable about the noted predetermined axis, either simultaneously with or independently of the feed means, and pressed against the successive articles for application of a coating substance thereto. One or more band-shaped coatings can thus be formed around each article by the coating means.

The feed means can take the form of a star wheel assembly normally comprising a pair of star wheels vertically spaced from and arranged in register with each other. The star wheel assembly feeds the articles, typically beverage bottles, along the arcuate path while pressing them against the opposed guide surface, with the result that each bottle rotates about its own axis in sliding contact with the star wheel pair and in frictional contact with the guide surface. The coating means may be in the form of one or more annular rows of discrete coating bodies or one or more coating rolls, as of sponge, coaxially mounted on the star wheel assembly.

Thus the coating apparatus according to the invention makes it possible to continually coat with a paint, paste or any other desired substance the successive bottles being fed along the arcuate path, without in any way interfering with their travel. Since the coating substance is applied by the coating bodies or rolls in sliding contact with the revolving bottles, the coatings formed thereon are more uniform in thickness than those formed by spraying or like methods. It is also possible in this manner to form a coating or coatings in exactly desired position on each bottle.

One of the advantages of this invention resides in the fact that the mentioned coating means can be compactly mounted on the star wheel assembly which finds widespread use as a bottle feed. Thus the coating apparatus demands, in fact, no particular installation space. Moreover, since the apparatus can be disposed at an arcuately curved portion of a bottling line, the bottles can travel a sufficiently long distance in sliding contact with the coating means for proper coating, in spite of the compactness of the apparatus.

In one application of the invention the coating means comprises a pair of coating rolls, or a pair of annular rows of coating bodies, coaxially mounted on the star wheel assembly and axially spaced from each other. The pair of coating rolls or the like can simultaneously coat the shoulder and bottom end portions of each bottle with a substance capable of protecting these vulnerable regions against scratches and other surface defects that may develop in various stages of the use of the bottles. Such protective coatings, though limited in areas, will effectively retain the aesthetic appeal of the bottles for an extended length of time.

The above and additional features and advantages of the present invention will become more apparent from a study of the following description of several preferred embodiments, in which reference is directed to the attached drawings.

DESCRIPTION OF THE PREFERRED EMBODIMENTS

Figure 1:
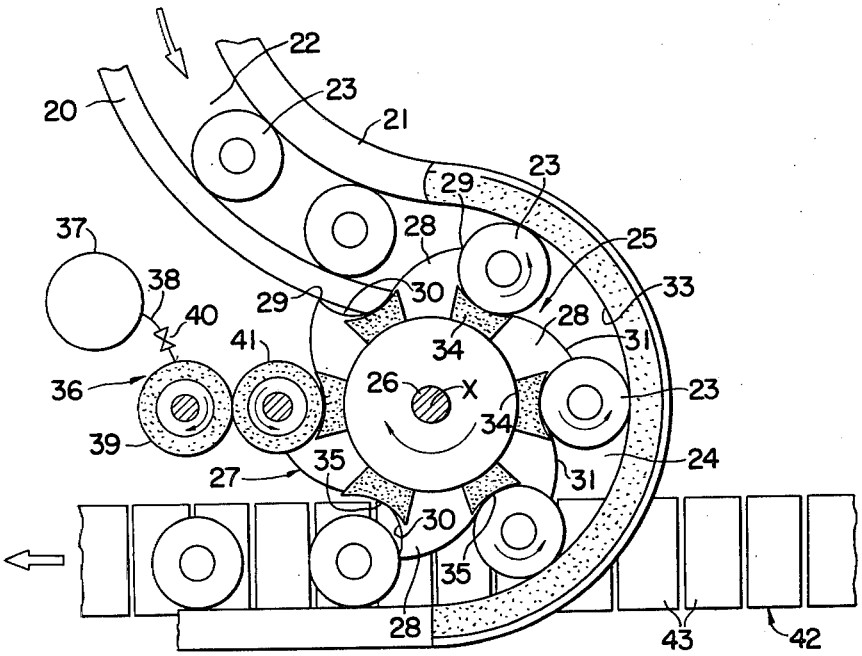
FIG. 1 is a top plan view, partly broken away for clarity, of the bottle coating apparatus constructed in accordance with the present invention.
Figure 2:
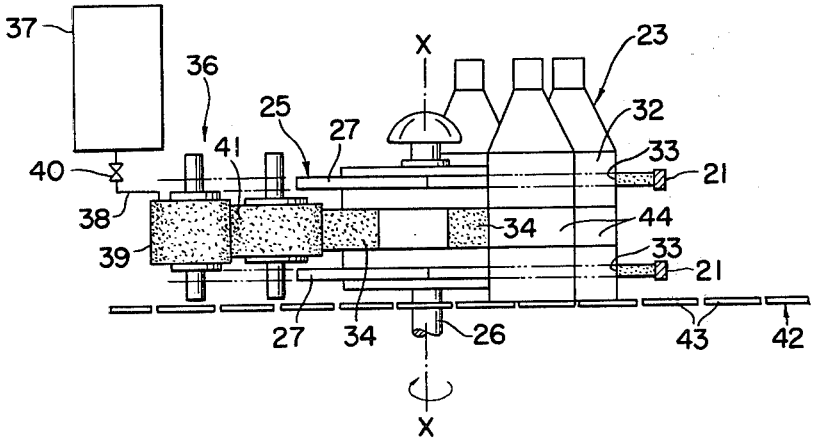
FIG. 2 is a side elevational view, partly in section, of the apparatus of FIG. 1.

FIGS. 1 and 2 of the above drawings illustrate the present invention as adapted for coating successive bottles, such as beer bottles, so as to create an endless band-shaped film of the coating substance encircling the mid-part of the cylindrical body of each bottle. The bottle coating apparatus of FIGS. 1 and 2 comprises two guide structures 20 and 21 extending horizontally in parallel spaced relationship to each other and defining therebetween a guideway 22 for the passage of the successive bottles 23 to be coated. The guideway 22 has an arcuately curved portion 24 centered at a vertical axis X—X. FIG. 2 reveals that at least the outer guide structure 21 is composed of a pair of vertically spaced guide rails, for purposes hereinafter made apparent.

The reference numeral 25 generally designates a star wheel assembly rotatable about the vertical axis X—X for feeding the bottles 23 along the arcuate guideway portion 24 in a manner to be detailed presently. The star wheel assembly 25 comprises an upstanding, rotatable drive shaft 26 whose axis coincides with the axis X—X, and a pair of spaced-apart star wheels 27 coaxially and fixedly mounted on the drive shaft 26 and arranged in approximately coplanar relationship to the guide rails of the outer guide structure 21. Extending downwardly from the star wheel pair 27, the drive shaft 26 is coupled to a suitable drive mechanism, not shown, which may include an electric motor. The unshown drive mechanism rotates the star wheel pair 27 in a clockwise direction as viewed in FIG. 1.

The star wheel pair 27 of the star wheel assembly 25 can be fabricated from fabric-reinforced Bakelite (trademark for any of various synthetic resins and plastics manufactured by Union Carbide Corporation, of the United States), monomer casting nylon, polyethylene, or like material. Each star wheel 27 comprises a plurality of, six in this particular embodiment, teeth 28 having a constant pitch. Each star wheel tooth 28 has a crest 29, a concave leading side 30, and a convex trailing side 31. At least the concave leading sides 30 of the star wheel teeth 28 should have smoothly finished surfaces for sliding contact with the cylindrical bodies 32 of the bottles 23 with as little frictional resistance as possible. The teeth 28 of the two star wheels 27 are in precise register with each other.

Thus the star wheel pair 27 engages the successive bottles 23 with the concave leading sides 30 of their teeth 28 and feeds the bottles along the arcuate guideway portion 24. While being thus fed along the arcuate guideway portion 24, each bottle 23 must revolve about its own axis in order to be coated. Toward this end, as best seen in FIG. 2, at least the inside guide surfaces 33 of the guide rail pair of the outer guide structure 21 are formed from neoprene sponge, rubber or like resin material capable of offering high frictional resistance to the bottles 23.

The star wheel pair 27 presses the bottles 23 against the inside surfaces 33 of the outer guide structure 21 while feeding them along the arcuate guideway portion 24. Consequently the bottles 23 rotate about their own axes, in a counterclockwise direction as viewed in FIG. 1, in sliding contact with the concave leading sides 30 of the star wheel teeth 28 and in frictional contact with the inside surfaces 33 of the outer guide structure 21.

Fixedly mounted on the drive shaft 26 and disposed between the pair of star wheels 27 are a plurality of, six in this embodiment, discrete coating bodies 34 arranged at constant angular spacings about the axis X—X. The coating bodies 34 can be formed from sponge, rubber, or like elastic material. Slightly projecting beyond the roots 35 of the star wheel pair 27, the coating bodies 34 are intended to make relative sliding contact with the cylindrical bodies 32 of the revolving bottles 23 for coating same.

The illustrated bottle coating apparatus further includes means 36 for supplying a desired coating substance to the coating bodies 34. The supplying means 36 include a reservoir or container 37 containing a suitable supply of the coating substance in a liquid state. A supply conduit 38 leading from the reservoir 37 is open to a supply roll 39 rotatable about its axis parallel to the axis X—X. A flow control valve 40 on the supply conduit 38 controls the flow rate of the coating liquid from the reservoir 37 to the supply roll 39. The supply roll 39 makes rolling contact with a transfer roll 41, which in turn makes rolling contact with the series of coating bodies 34.

Shown at 42 is a conveyor comprising an endless series of articulated plate elements 43. The arcuate portion 24 of the guideway 22 ends at and opens to the conveyor 42, so that the coated bottles are successively fed out onto the conveyor.

In operation the succession of bottles 23 to be coated are fed by suitable means, not shown, along the guideway 22 to the entrance of its arcuate portion 24. The star wheel assembly 25 engages the successive bottles 23 with the concave leading sides 30 of its teeth 28 at the entrance of the arcuate guideway portion 24 and feeds the bottles while pressing them into frictional contact with the inside surfaces 33 of the outer guide structure 21. Since the bottles 23 are in sliding contact with the concave leading sides 30 of the star wheel teeth 28, the bottles rotate about their own axes as they travel along the arcuate guideway portion 24 about the axis X—X.

The supply roll 39 of the coating substance supplying means 36 is constantly impregnated with the coating liquid delivered from the reservoir 37 at a controlled rate. The transfer roll 41 functions to make the thickness of the coating liquid uniform in the transverse or vertical direction as it transfers the liquid from the supply roll 39 to the series of coating bodies 34. These coating bodies are held pressed against and in sliding contact with the respective cylindrical bodies 32 of the bottles 23 being fed along the arcuate guideway portion 24 in the above described manner.

FIG. 2 shows a coating 44 thus formed on each bottle body 32 in the form of an endless band. It will be readily seen that the coating substance could be applied to substantially the entire surface of each bottle body 32, simply by increasing the vertical dimension of each coating body 34 and the spacing between the pair of star wheels 27.

The star wheel assembly 25 feeds the successive coated bottles 23 away from the guideway 22 and on to the conveyor 42. This conveyor transports the coated bottles 23 to the next processing stage. If desired or required, means may be provided for quickly drying the coatings 44 on the bottles 23, as by application of heat, before the bottles reach the next processing stage.

Figure 3:
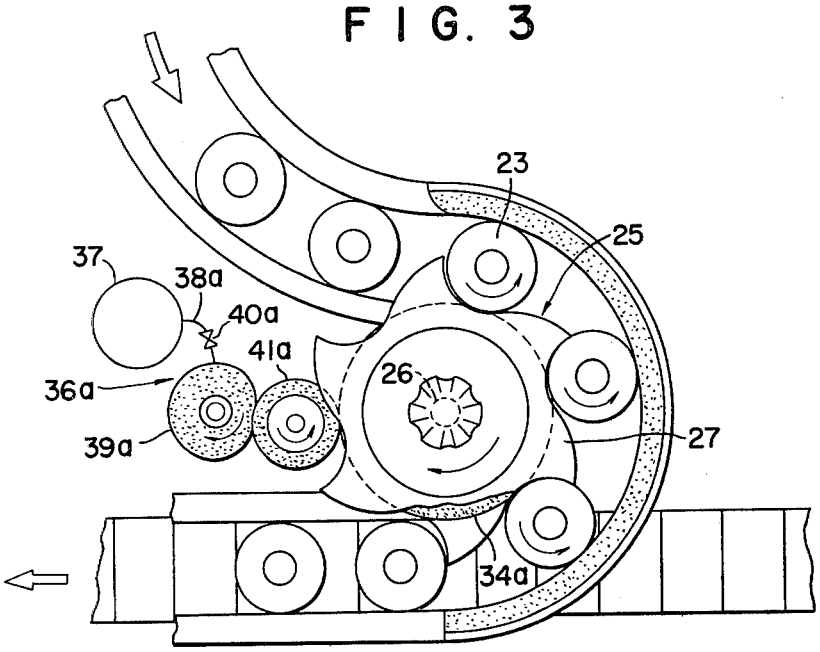
FIG. 3 is a top plan view, partly broken away for clarity, of another preferred form of the bottle coating apparatus.
Figure 4:
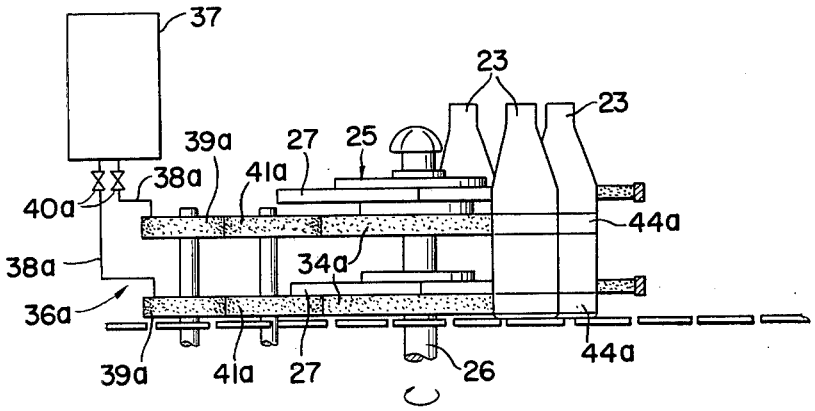
FIG. 4 is a side elevational view, partly in section, of the apparatus of FIG. 3.

FIGS. 3 and 4 show the bottle coating apparatus of this invention as modified for forming two endless band-shaped coatings in axially spaced positions on the cylindrical body of each bottle. The modified bottle coating apparatus includes the star wheel assembly 25 of the same construction as that shown in FIGS. 1 and 2. The primary difference resides in two coating rolls 34*a* of sponge, rubber or like material fixedly mounted on the star wheel drive shaft 26, one under the upper star wheel 27 and the other under the lower star wheel 27. The two coating rolls 34*a* partly project beyond the roots of the star wheel pair 27.

The coating rolls 34*a* may be so positioned on the star wheel drive shaft 26, in relation to the bottles 23 to be coated, that the two endless band-shaped coatings 44*a* may be formed at the shoulder and bottom end portions of each bottle. Thus the modified coating apparatus lends itself for use in applying protective coatings to those parts of the bottles where scratches and other surface defects are most liable to occur. It is to be noted that each coating roll 34*a* is equivalent in function to the series of discrete coating bodies 34 in FIGS. 1 and 2.

Also included in the modified bottle coating apparatus are means 36*a* for supplying the protective coating substance to the two coating rolls 34*a*. The supplying means 36*a* comprise two supply rolls 39*a* rotatable about a common vertical axis and receiving the coating liquid from the reservoir 37 by way of respective conduits 38*a*. A flow control valve 40*a* on each conduit 38*a* controls the flow rate of the coating liquid from the reservoir 37 to one of the supply rolls 39*a*. Two transfer rolls 41*a* make rolling contact with the respective supply rolls 39*a* on one hand and, on the other hand, with the respective coating rolls 34*a* for the transfer of the coating liquid from the former to the latter.

The other details of construction of this modified apparatus can be as set forth above in connection with FIGS. 1 and 2. The method of its operation is also identical with that of the preceding embodiment.

Figure 5:
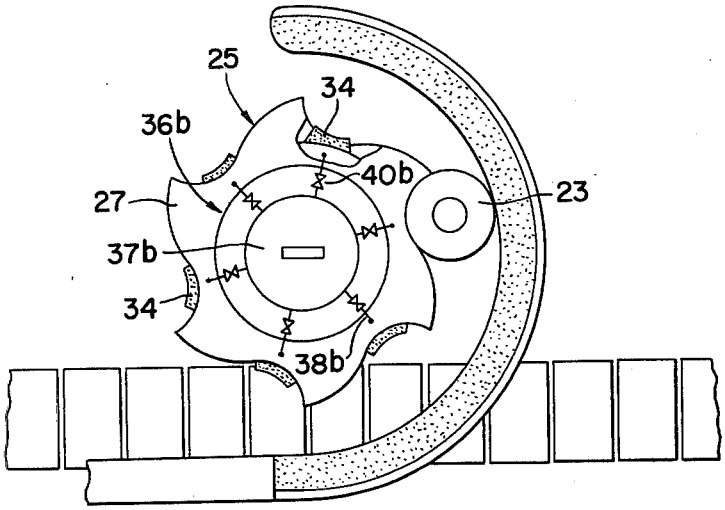
FIG. 5 is a top plan view, partly broken away for clarity, of still another preferred form of the bottle coating apparatus.
Figure 6:
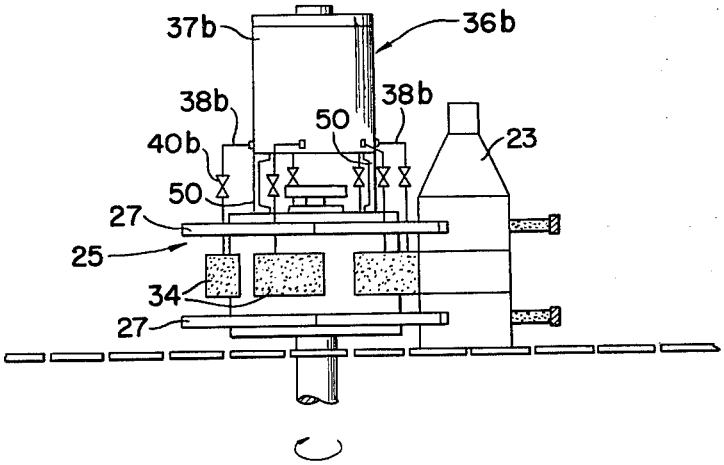
FIG. 6 is a side elevational view, partly in section, of the apparatus of FIG. 5.

In FIGS. 5 and 6 is shown another slight modification of the bottle coating apparatus, which features means 36*b* mounted on the star wheel assembly 25 for supplying a desired coating liquid to the series of coating bodies 34. The construction of the star wheel assembly 25, and the arrangement of the coating bodies 34, can themselves be as already stated with reference to FIGS. 1 and 2.

The supplying means 36*b* of FIGS. 5 and 6 include a cylindrical container or tank 37*b* fixedly and concentrically mounted on the star wheel assembly 25 via several legs 50 for simultaneous rotation with the pair of star wheels 27. Supply conduits 38*b* extend radially from the bottom end portion of the container 37*b*. Passing downwardly through the upper star wheel 27, all the supply conduits 38*b* terminate short of and open to the respective coating bodies 34. Alternatively the supply conduits 38*b* may project into the respective coating bodies 34. A flow control valve 40*b* on each supply conduit 38*b* controls the flow rate of the coating liquid from the container 37*b* to one of the coating bodies 34.

During the operation of the apparatus the container 37*b* is in constant rotation with the star wheel assembly 25, so that the coating liquid can be centrifugally sent out of the container into the supply conduits 38*b*, for delivery onto or into the coating bodies 34. These coating bodies apply the coating liquid to the successive bottles 23 as in the embodiment of FIGS. 1 and 2. It will be apparent that the teachings of FIGS. 5 and 6 are applicable to the FIGS. 3 and 4 embodiment as well.

Figure 7:
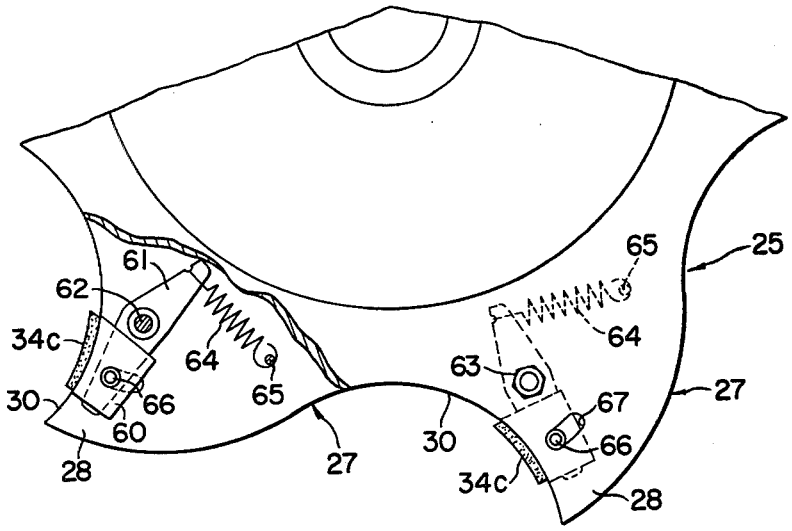
FIG. 7 is a partial top plan view, partly broken away for clarity, of a further preferred form of the bottle coating apparatus.
Figure 8:
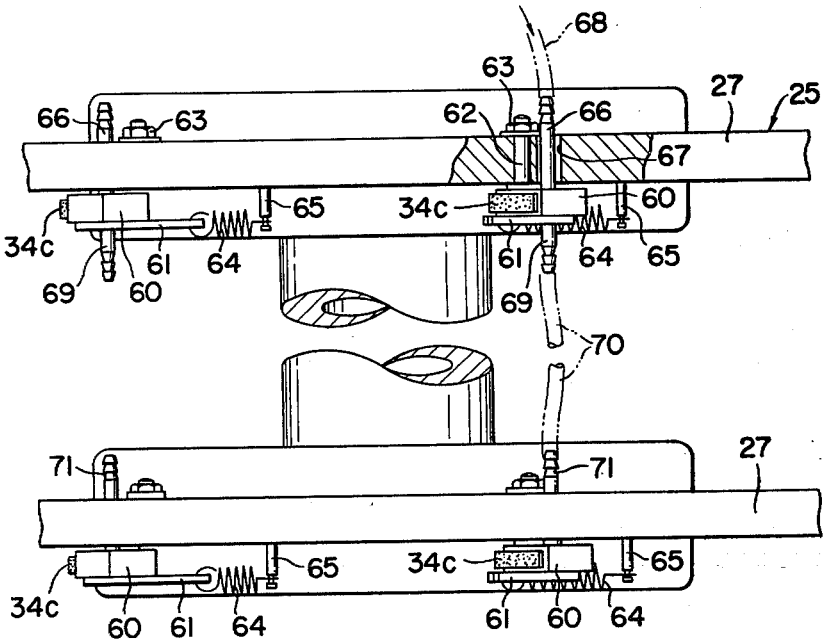
FIG. 8 is a partial side elevational view, partly broken away for clarity, of the apparatus of FIG. 7.

In a further preferred embodiment shown in FIGS. 7 and 8 a series of discrete coating bodies 34*c* are mounted under each star wheel 27 of the star wheel assembly 25, for forming two endless band-shaped coatings on each bottle as in the FIGS. 3 and 4 embodiment. Each coating body 34*c*, however, is made adjustably movable up and down relative to the star wheel assembly 25 and is further sprung into sliding engagement with the bottle being coated. The following description will make clear the means for the attainment of these additional features.

Each coating body 34*c* is partly enclosed in a holder 60, with its coating surface of sponge or mesh projecting from the holder and from the concave leading side 30 of one of the teeth 28 of one of the star wheels 27. The coating body 34*c* with its holder 60 is fixedly mounted on one end of a swing arm 61 pivotally mounted on the underside of one of the star wheels 27 via an upstanding shaft or pin 62. This shaft 62 slidably extends upwardly through the star wheel 27 and makes threaded engagement with a nut 63. By turning this nut 63, therefore, the vertical position of the shaft 62, and hence of the coating body 34*c*, is adjustably variable within limits with respect to the star wheel 27.

A coiled tension spring 64 extends between the other end of each swing arm 61 and a spring retainer pin 65 extending downwardly from one of the star wheels 27. The tension spring 64 biases the swing arm 61 in a clockwise direction, as viewed in FIG. 7, thereby energizing the coating body 34*c* outwardly of the concave leading side 30 of one of the star wheel teeth 28. The two series of coating bodies 34*c* will create coatings of uniform thickness on successive bottles because the coating bodies are urged against the respective bottles under constant spring pressure. The springing of the coating bodies is also effective to protect them from rapid or uneven wear.

For supplying a desired coating liquid to the upper series of coating bodies 34*c* a short, rigid pipe 66 slidably extends through each of several arcuate slots 67 formed in the upper star wheel 27 in register with the respective coating bodies or with their holders 60. Each rigid pipe 66 is coupled at its top end to a flexible conduit 68 for communication with a coating liquid container, not shown in FIGS. 7 and 8, that is assumed to be mounted on the star wheel assembly 25 as in the embodiment of FIGS. 5 and 6. At its bottom end each pipe 66 is coupled to one of the coating body holders 60 and opens to the coating body 34*c* for delivering the coating liquid thereto.

The bottom end of each pipe 66 further communicates with a short pipe 69 extending downwardly from each coating body holder 60. Each pipe 69 communicates by way of a flexible conduit 70 with another short, rigid pipe 71 slidably extending through one of several arcuate slots, similar to the slots 67, formed in the lower star wheel 27. Each rigid pipe 71 is coupled to one of the holders 60 of the lower series of coating bodies 34*c* and opens to the coating body therein for the delivery of the coating liquid.

Each arcuate slot 67 in the star wheels 27 is centered at the pivot 62 of the corresponding one of the swing arms 61. With the pivotal motion of the swing arms 61, therefore, the rigid pipes 66 and 71 slide along the arcuate slots 67. These rigid pipes also function as stops limiting the pivotal motion of the swing arms 61, normally holding the coating bodies 34*c* in the position best seen in FIG. 7.

The coating liquid is supplied at controlled rates into all the coating body holders 60 during the operation of the apparatus. The thus supplied coating liquid will permeate through the coating bodies 34*c* and ooze from their coating surfaces, partly by centrifugal forces and partly under pressures forcing the coating liquid from the container into the coating body holders 60. Since the coating bodies 34*c* are adjustably movable up and down relative to the star wheel assembly 25, their vertical positions may be adjusted as required to apply, for example, protective coatings to the shoulder and bottom end portions of the bottles, as has been explained in connection with FIGS. 3 and 4.

Figure 9:
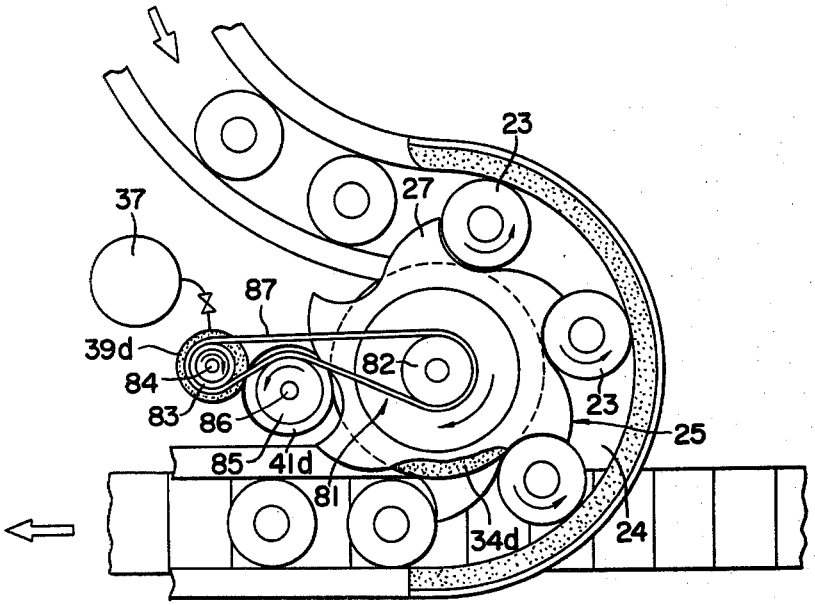
FIG. 9 is a top plan view, partly broken away for clarity, of a further preferred form of the bottle coating apparatus.
Figure 10:
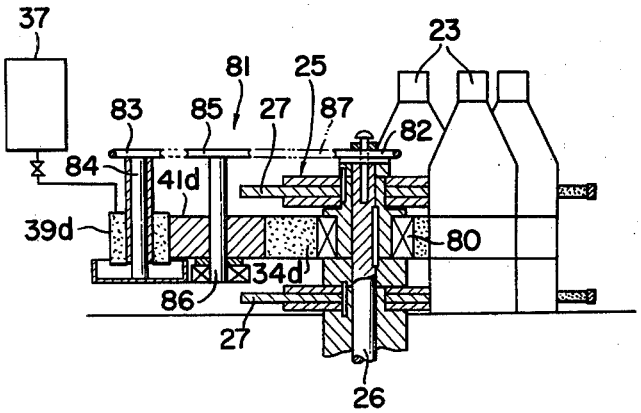
FIG. 10 is a vertical sectional view of the apparatus of FIG. 9.

FIGS. 9 and 10 show the bottle coating apparatus as adapted for use with coating substances that are comparatively high in viscosity and low in adhesiveness to bottles or like articles. For uniform application of such coating substances to desired surfaces this embodiment employs means for introducing a difference between the peripheral speed of a coating roll 34*d*, or equivalent means, and that of the star wheel assembly 25, as will become better understood from the following description.

The star wheel assembly 25 is itself analogous with that of, for example, FIGS. 1 and 2, including the drive shaft 26 and the pair of star wheels 27 fixedly mounted thereon. Between the star wheels 27 the coating roll 34*d* is rotatably mounted on the drive shaft 26 via a bearing or synthetic-resin bushing 80. The coating roll 34*d* is in frictional contact with a transfer roll 41*d*, which in turn is in frictional contact with a supply roll 39*d*.

Generally designated 81 is a belt drive for imparting the rotation of the star wheel assembly 25 to the supply roll 39*d* and the transfer roll 41*d* and further for driving the coating roll 34*d* at a different peripheral, and angular, speed from the star wheel assembly. The belt drive 81 includes a drive pulley 82 mounted on the top end of the star wheel drive shaft 26 for simultaneous rotation therewith. A driven pulley 83 is mounted on the top end of a shaft 84 for simultaneous rotation therewith and with the supply roll 39*d* also mounted thereon. Another driven pulley 85 is fixedly mounted on the top end of a shaft 86 rigidly supporting the transfer roll 41*d*. An endless belt 87 extends around the drive pulley 82 and the driven pulleys 83 and 85 as shown in FIG. 9.

Thus driven from the star wheel assembly 25 via the belt drive 81, the supply roll 39*d* and the transfer roll 41*d* rotate at the same peripheral speed but in opposite directions, in rolling contact with each other. The supply roll 39*d* receives the viscous coating liquid from the reservoir 37, and the transfer roll 41*d* passes the coating liquid on to the coating roll 34*d*. The transfer roll 41*d* also acts to rotate the coating roll 34*d* at a different (lower in this case) peripheral speed than that of the star wheel assembly 25.

It is thus seen that the coating roll 34*d* can be driven at any desired peripheral speed, different from that of the star wheel pair 27, by appropriately selecting the relative diameters of the drive 82 and driven 83 and 85 pulleys and of the transfer roll 41*d* and the coating roll 34*d*.

The coating roll 34*d* rotates in the same direction as the star wheel assembly 25 in this particular embodiment. It is of course possible to drive the star wheel assembly 25 and the coating roll 34*d* in opposite directions, as by interposing another transfer roll between the transfer roll 41*d* and the coating roll 34*d*. Further, although the supply roll 39*d* and the transfer roll 41*d* are both driven directly from the star wheel assembly 25 in the illustrated embodiment, only either of the supply and transfer rolls may be so driven from the star wheel assembly. The other of the supply and transfer rolls, as well as the coating roll 34*d*, will then rotate in frictional contact with the roll being driven directly from the star wheel assembly 25.

The coating roll 34*d* applies the coating liquid to the successive bottles 23 by maintaining relative sliding contact therewith as the star wheel pair 27 feeds the bottles along the arcuate guideway portion 24 while causing rotation of each bottle about its own axis, as in all the preceding embodiments. Because of the difference between the rotative speeds of the star wheel pair 27 and the coating roll 34*d*, the latter acts to more positively apply the coating liquid to the desired surface portion of each bottle. Thus, no matter how viscous and poor in adhesiveness it may be, the coating liquid can be firmly and uniformly coated on the successive bottles.

Figure 11:
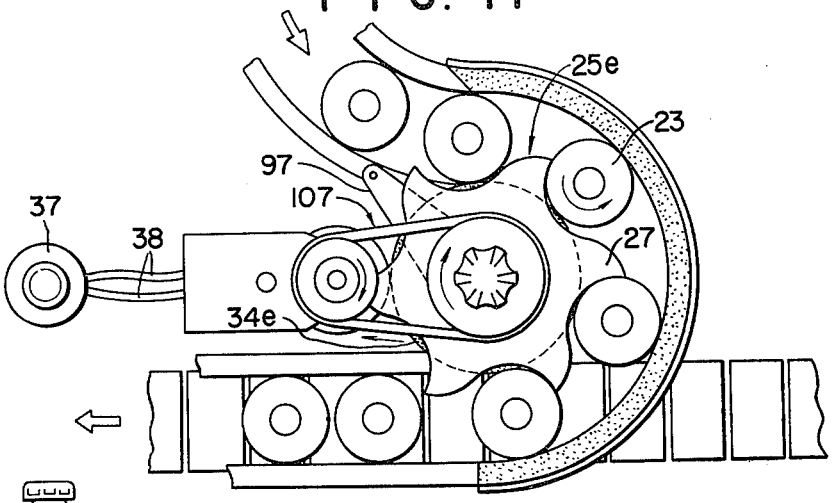
FIG. 11 is a top plan view of a further preferred form of the bottle coating apparatus.
Figure 12:
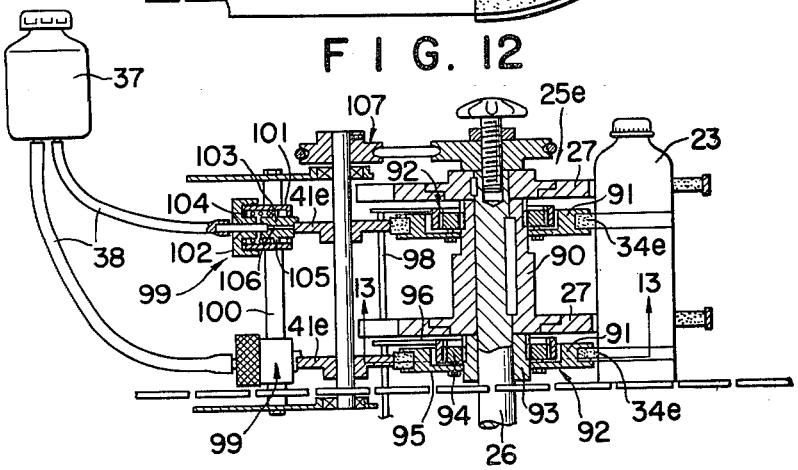
FIG. 12 is a vertical sectional view of the apparatus of FIG. 11.
Figure 13:
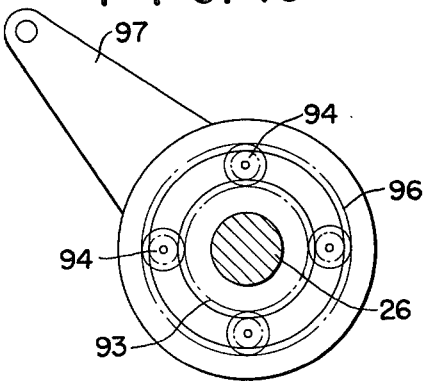
FIG. 13 is an enlarged sectional view taken along the line 13—13 of FIG. 12 and showing one of the two identical planetary gear trains used in the apparatus of FIGS. 11 and 12.

A further preferred embodiment shown in FIGS. 11, 12 and 13 incorporates a pair of coating rolls 34*e*, disposed one under each star wheel 27 of a star wheel assembly 25*e*, as in the FIGS. 3 and 4 embodiment. The embodiment of FIGS. 11–13 features modified or more refined means for driving each coating roll 34*e* at a lower speed than the star wheel assembly 25*e*, and modified means for supplying a coating substance to the pair of coating rolls 34*e*.

As best shown in FIG. 12, the star wheel assembly 25*e* has a sleeve 90 mounted on the drive shaft 26 for simultaneous rotation therewith. The sleeve 90 is formed integral with the pair of star wheels 27. Carried by a rotatable, annular holder 91 coaxially surrounding the drive shaft 26, each coating roll 34*e* is driven from the drive shaft via a planetary gear train 92.

With reference directed also to FIG. 13 the lower planetary gear train 92, underlying the lower star wheel 27, includes a sun wheel or gear 93 fixedly sleeved upon the drive shaft 26. The sun wheel 93 meshes with a plurality of, four in this embodiment, planet gears or pinions 94 rotatably mounted on a planet carrier 95 formed integral with the lower coating roll holder 91. The planet carrier 95 together with the coating roll holder 91 is rotatable relative to the sun wheel 93. The lower planetary gear train 92 further includes an internally toothed annulus 96 in mesh with the planet gears 94. The annulus 96 is anchored against rotation by an arm 97 formed integral therewith and coupled to a stationary post 98 or any other suitable stationary member. The upper planetary gear train 92 is of essentially identical make except that its sun wheel is formed by a part of the sleeve 90.

The two planetary gear trains 92 act to transmit the rotation of the drive shaft 26 to the respective coating rolls 34*e*, with reduction in speed but without altering the direction of rotation. Thus driven positively from the drive shaft 26, the pair of coating rolls 34*e* rotate at an exactly constant speed for uniformly and efficiently coating the successive bottles 23.

The noted modified means for supplying the coating liquid to the coating roll pair 34*e* include a pair of dispensers 99, FIG. 12, secured to a stationary post 100. The dispensers 99 receive the coating liquid from the reservoir 37 by way of the respective flexible conduits 38 such as silicone resin tube, vinyl resin tube and deliver the coating liquid on to the respective coating rolls 34*e* via respective transfer rolls 41*e* rotatable about a common vertical axis.

Since the pair of dispensers 99 are exactly identical in construction, only the upper dispenser will be described in detail with reference to FIG. 12. The upper dispenser 99 includes a housing 101 having an open end, directed away from the upper transfer roll 41*e*, closed by a cap 102. A slidable dispenser element 103 is received in the housing 101 for sliding movement in the radial direction of the upper transfer roll 41*e*. *The dispenser element 103 partly projects our of an opening formed in the housing 101 for relative sliding contact with the periphery of the upper transfer roll 41e.* A coiled compression spring 104 extends between the housing end cap 102 and a spring seat 105 formed integral with the dispenser element 103, for biasing the dispenser element into abutment against the upper transfer roll 41*e*. The dispenser element 103 has formed therein a channel 106 communicating at one end with the reservoir 37 and open at the other end to the upper transfer roll 41*e*.

Driven from the star wheel assembly 25*e* via a belt drive 107, the pair of transfer rolls 41*e* jointly rotate in sliding contact with the respective dispenser elements 103 under the bias of the compression springs 104. The pair of dispensers 99 dispense the coating liquid from the channels 106 of their elements 103 on to the respective transfer rolls 41*e*. The rates of delivery of the coating liquid from the dispensers 99 can be controlled by adjusting the spring pressures under which the dispenser elements 103 are urged against the respective transfer rolls 41*e*.

A consideration of FIGS. 11 and 12 will reveal that the pair of transfer rolls 41*e* rotate in the same direction as the star wheel assembly 25*e* and the coating roll pair 34*e*. This helps to simplify the construction of the belt drive 107 or like means for transmitting the rotation of the star wheel assembly 25*e* to the transfer roll pair 41*e*.

Figure 14:
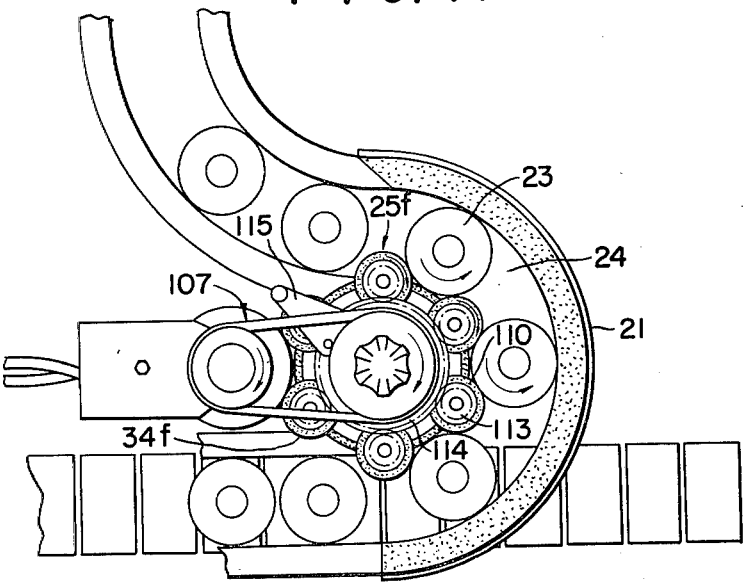
FIG. 14 is a top plan view of a still further preferred form of the bottle coating apparatus.
Figure 15:
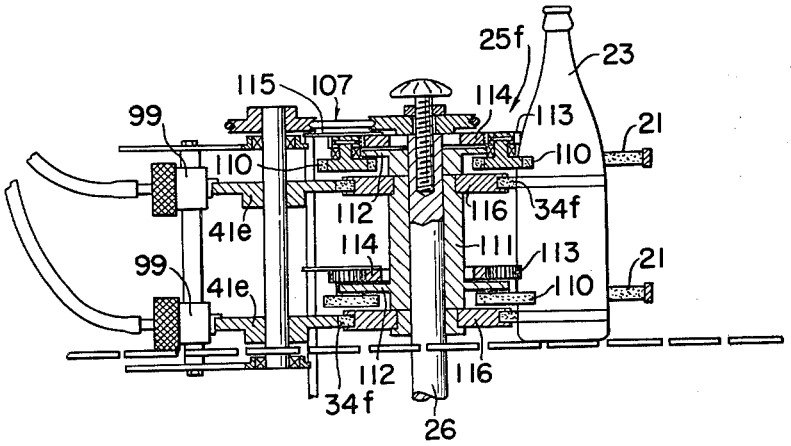
FIG. 15 is a vertical sectional view of the apparatus of FIG. 14.

FIGS. 14 and 15 are illustrations of a still further preferred embodiment, in which the star wheel assembly used in all the preceding embodiments is replaced by a feed roll assembly 25*f* comprising two series of feed rolls 110 in annular arrangement. This embodiment also employs a pair of coating rolls 34*f*, disposed one under each series of feed rolls 110, as in the embodiments of FIGS. 3 and 4 and FIGS. 11–13. The coating roll pair 34*f* is, however, free to rotate relative to the drive shaft 26 as the embodiment shown in the FIGS. 9 and 10.

The feed roll assembly 25*f* includes a sleeve 111 fixedly mounted on the drive shaft 26 and formed integral with a pair of spaced-apart flanges 112. Each flange 112 has a plurality of, six in this embodiment, feed rolls 110 rotatably mounted thereon at constant angular spacings about the axis of the drive shaft 26. Each feed roll 110 is therefore rotatable about the axis of the drive shaft 26 and also about its own axis parallel to the drive shaft axis. The feed rolls 110 are to make frictional contact with the bottles 23 being coated, so that at least the peripheral surfaces of the feed rolls should be formed from material capable of offering high frictional resistance to glass bottles or like articles.

Also rotatably mounted on each flange 112 are pinions 113, as of the spur gear type, arranged in axial alignment with the respective feed rolls 110 on the flange. The pinions 113 are integrally coupled to the respective feed rolls 110 for simultaneous rotation therewith. Each annular series of pinions 113 mesh with a central gear 114 loosely and coaxially mounted on the drive shaft 26. Each central gear 114 is locked against rotation as by an arm 115. Each arm 115 is fixedly mounted on a stationary post or any other suitable stationary member.

The pair of coating rolls 34*f*, each carried by a disc-like holder 116, are disposed under the respective rows of feed rolls 110 and rotatably mounted on the sleeve 111 on the drive shaft 26. These coating rolls 34*f* make rolling contact with the respective transfer rolls 41*e* set forth in connection with FIGS. 11 and 12. Also as in the FIGS. 11–13 embodiment the pair of transfer rolls 41*e* are driven from the drive shaft 26 via the belt drive 107 and jointly rotate in sliding contact with the respective dispensers 99.

In operation, upon rotation of the drive shaft 26 in a clockwise direction as viewed in FIG. 14, the two series of feed rolls 110 revolve in the same direction about the axis of the drive shaft, feeding the successive bottles 23 along the arcuate guideway portion 24, with each bottle engaged between two adjacent ones of each series of feed rolls. Each feed roll 110 also rotates in a clockwise direction about its own axis. This is because the pinions 113 integral with the respective feed rolls 110 are in mesh with the fixed central gears 114. Thus the two series of feed rolls 110 coact with the outer guide structure 21 to frictionally cause rotation of each bottle 23 in a counterclockwise direction about its own axis. Essentially, therefore, the feed rolls 110 are equivalent in function to the teeth of the star wheels used in all the preceding embodiments.

As in the FIGS. 11–13 embodiment the pair of transfer rolls 41*e* receive the coating liquid from the respective dispensers 99 and pass the coating liquid on to the respective coating rolls 34*f*. These coating rolls apply the coating liquid to the successive bottles 23 in a manner apparent from the description of the foregoing embodiments.

It is understood that the several preferable embodiments disclosed herein are not to impose limitations upon the present invention but permit departures therefrom within the scope of the invention. For example, while all the foregoing embodiments represent apparatus for coating bottles, the invention could be embodied in apparatus for coating cans or other cylindrical or round articles. Further the star wheels employed in all but the last of the above described embodiments may each have not necessarily six, but any desired number of, teeth and may be shaped differently from those shown. It is also possible to apply a coating substance to desired articles by means of brushes, rather than by the coating bodies or rolls in the illustrated embodiments, and to supply the coating substance to such coating means by spraying. Still further the belt drive in some of the embodiments may be replaced by gearing, chain drive, or other types of power transmissions.

What is claimed is:

1. Apparatus for coating a succession of substantially cylindrical or round articles such as bottles with a desired coating substance, comprising, in combination:

(a) Guide means defining an arcuate guideway for the passage of successive articles to be coated, said arcuate guideway being centered at a predetermined axis and said guide means having an arcuate guide surface made of a material capable of offering a high frictional resistance to each article to be coated;

(b) feed means comprising at least one star wheel for feeding the successive articles along the arcuate guideway while pressing the articles against the guide surface of the guide means itself, said star wheel having teeth each of which has at least a concave leading side having a smoothly finished surface for sliding contact with the article with a little frictional resistance, whereby said star wheel is adapted to permit rotations of each article about its own axis in sliding contact with the star wheel and in frictional contact with the guide surface of the guide means;

(c) coating means rotatable about a predetermined axis and adapted to be pressed against the successive articles being fed along the arcuate guideway for application of a desired coating substance thereto; and (d) whereby at least one band-shaped film of the coating substance is created around each article by the coating means.

2. The coating apparatus according to claim 1, wherein the coating means is mounted on the feed means for simultaneous rotation therewith.

3. The coating apparatus according to claim 1 or 2, wherein the coating means comprises at least one series of discrete coating bodies arranged at constant angular spacings about the predetermined axis.

4. The coating apparatus according to claim 3, further comprising means for biasing each coating body into relative sliding contact with one of the articles traveling along the arcuate guideway.

5. The coating apparatus according to claim 1 or 3, further comprising means for adjustably moving the coating means in the axial direction of the feed means.

6. The coating apparatus according to claim 1 or 3, wherein the coating means comprises at least one coating roll.

7. The coating apparatus according to claim 1 or 2, further comprising means for supplying the coating substance to the coating means, the supplying means comprising:

(a) a supply roll rotatable about an axis parallel to the predetermined axis;

(b) means for delivering the coating substance to the supply roll at a controlled rate; and (c) a transfer roll rotatable in contact with the supply roll and with the coating means for passing the coating substance from the supply roll on to the coating means.

8. The coating apparatus to claim 1 or 2, further comprising means for supplying the coating substance to the coating means, the supplying means comprising:

(a) a container for containing a supply of the coating substance, the container being mounted on the feed means for simultaneous rotation therewith; and (b) means for delivering the coating substance from the container to the coating means at a controlled rate.

9. The coating apparatus according to claim 1, wherein the coating means is coaxially mounted on the feed means for rotation relative to same, and wherein the apparatus further comprises means for rotating the coating means at a different speed from the feed means.

10. The coating apparatus according to claim 9, wherein the apparatus includes a roll in rolling contact with the coating means for supplying the coating substance thereto, and wherein the rotating means comprises means for imparting the rotation of the feed means to the roll.

11. The coating apparatus according to claim 9, wherein the rotating means comprises a planetary gear train connected between the feed means and the coating means.

12. The coating apparatus according to claim 1, further comprising a dispenser for supplying the coating to the coating means, the dispenser comprising:

(a) a fixed housing (b) a dispenser element slidably mounted within the housing for movement toward and away from the coating means and partly projecting outwardly therefrom for dispensing the coating substance; and (c) means for biasing the dispenser element toward the coating means.

13. The coating apparatus according to claim 12, further comprising a transfer roll rotatably mounted between the dispenser and the coating means for passing the coating substance from the former to the latter, the dispenser element being biased into relative sliding contact with the transfer roll.

* * * * *